US008237376B2

(12) United States Patent
Franco

(10) Patent No.: US 8,237,376 B2
(45) Date of Patent: Aug. 7, 2012

(54) FAST SWITCHING, OVERSHOOT-FREE, CURRENT SOURCE AND METHOD

(75) Inventor: Pasquale Franco, Placanica (IT)

(73) Assignee: STMicroelectronics S.R.L., Agrate Brianza (MI) (IT)

( * ) Notice: Subject to any disclaimer, the term of this patent is extended or adjusted under 35 U.S.C. 154(b) by 347 days.

(21) Appl. No.: 12/727,877

(22) Filed: Mar. 19, 2010

(65) Prior Publication Data

US 2010/0295476 A1 Nov. 25, 2010

(30) Foreign Application Priority Data

Mar. 20, 2009 (IT) ..... VA2009A0021

(51) Int. Cl.
*G05F 1/00* (2006.01)

(52) U.S. Cl. ..... 315/291; 315/224; 315/312; 315/315; 315/320; 323/281; 323/282; 323/314; 323/315; 327/332

(58) Field of Classification Search ..... 315/169.1, 315/169.3, 291, 224, 226, 209 R, 216, 312, 315/313, 315, 316, 320; 323/281, 282, 312–316; 327/328, 332

See application file for complete search history.

(56) References Cited

U.S. PATENT DOCUMENTS

| | | | | |
|---|---|---|---|---|
| 5,272,432 | A * | 12/1993 | Nguyen et al. | 323/315 |
| 6,144,222 | A | 11/2000 | Ho | 326/82 |
| 6,288,696 | B1 | 9/2001 | Holloman | 345/84 |
| 6,313,694 | B1 | 11/2001 | Sohn | 327/541 |
| 6,346,711 | B1 | 2/2002 | Bray | 250/551 |
| 6,469,405 | B1 | 10/2002 | Moya et al. | 307/130 |
| 6,734,875 | B1 | 5/2004 | Tokimoto et al. | 345/690 |
| 2007/0096797 | A1 | 5/2007 | Camara et al. | 327/540 |
| 2008/0012507 | A1 | 1/2008 | Nalbant | 315/306 |

FOREIGN PATENT DOCUMENTS

WO 2009/024547 2/2009

OTHER PUBLICATIONS

Alon et al., "Replica compensated linear regulators for supply-regulated phase-locked loops", IEEE Journal of Solid-State Circuits, vol. 41, No. 2, Feb. 2006, pp. 413-424.

* cited by examiner

*Primary Examiner* — Haiss Philogene
(74) *Attorney, Agent, or Firm* — Allen, Dyer, Doppelt, Milbrath & Gilchrist, P.A.

(57) ABSTRACT

A method and a circuit may have an ability to provide constant currents of a certain set value, the rising and falling edges of which may be shorter than the design minimum on-phase. Essentially, these results may be obtained by keeping an operational amplifier that controls the output power switch in an active state during off-phases of an impulsive drive signal received by the current source circuit in order to maintain the output voltage of the operational amplifier at or just below the voltage to be applied to the control terminal of the output power switch during a successive on-phase of a received drive pulse signal.

33 Claims, 18 Drawing Sheets

SOURCE FOLLOWER OUTPUT STAGE

EMITTER FOLLOWER OUTPUT STAGE

FAST SWITCHING, OVERSHOOT-FREE, CURRENT SOURCE AND METHOD

FIELD OF THE INVENTION

The present invention relates in general to fast switching current sources for driving electrical loads, and in particular, to fast switching current sources adapted to drive electrical loads without generating current spikes or significant overshoots.

BACKGROUND OF THE INVENTION

There are many applications that use fast switching, overshoot free current sources, especially though not exclusively in communications and digital data transmission systems, full motion color display video applications, opto-isolators drivers, infrared light emitting diode (LED) communication devices operating at high data rate, general purpose LED drivers in devices with or without serial interface, and in display devices where the light intensity is current dependent. In view a prominent importance among the numerous applications of fast switching, overshoot free current sources, the ensuing description may exemplarily refer to the driving of an electrical load in the form of an LED, though other equivalent electrical loads may be similarly driven.

FIG. 1 shows a basic LED driver circuit suitable for monolithic multi-channel drivers for LED panel displays, a partial block diagram of which is shown in FIG. 2. Light output is a function of current $I_{OUT}$; by changing $I_{BIAS}$, which has a ratio K with $I_{OUT}$, it is possible to modulate the intensity level. The "reference" and the "sensing" (feedback) resistors may be of the same-type and well-matched.

In an integrated circuit (IC), the biasing current $I_{BIAS}$ is usually the result of a processing/amplification (e.g.: 1:1) of an input current, generated by the user on an external resistor, coupled to a suitable pad and biased by a temperature and supply compensated voltage reference (typically a Band Gap reference). The output current is thus temperature and supply independent and a DMOS, if technologically available, is often employed as a power output element.

The MOS $M_{GSW}$ (FIG. 1) acts as a switch and grounds the gate of the power element, thereby preventing it from remaining floating when the driver is disabled (ENABLE=0). In these conditions the op-amp has its input and output terminals to zero voltage.

When the driver is enabled (ENABLE=1), supposing the positive input rises instantaneously, the op-amp has to raise its output (i.e. the gate of the power) from zero to at least the threshold voltage of the DMOS (in a worst scenario, up several hundreds mV, when operating at the internal supply voltage value). The op-amp negative input may be increased (usually from few tenths of mV to several hundreds mV) to the appropriate value: $V_{SENS}=V_{REF}$, for setting the output current to the design value.

Passing from one situation to another, not in "small signal" conditions, the dynamic response of the system is basically conditioned by the slew-rate of the op-amp. Slew rate (SR) is related to the dominant pole of the open loop amplifier and to the charging current of the gate capacitance (including the Miller capacitance). The most general kind of operational amplifier is depicted in FIG. 3 and by definition:

$$SR = \left[\frac{dVo}{dt}\right]_{max} = \frac{I_{O1}}{C_C}, \text{ and}$$

$C_C$ is the capacitance needed to introduce a dominant pole to compensate the op-amp. Remembering that $$f_T = \frac{gm1}{2\pi C_C}, \text{ and}$$

$$SR = \frac{I_{O1}}{gm1} 2\pi f_T;$$

slew rate can be increased by increasing the transition frequency $f_T$ value and/or the saturation current $I_{O1}$ of the first stage or by decreasing the $g_{m1}$ of the same stage.

Many drivers may be able to switch high currents (for example, 80 mA, 100 mA, 500 mA) and this usually calls for the use of large output transistors (Power-DMOS) that have large feedback parasitic capacitance ($C_{GD}$), which in turn appears multiplied by the gain of the output stage ($gm*R_L$) of the driver and increases with diminishing drain voltage, affecting the dynamic performances of the circuit.

In LED panel displays applications, the LED brightness is usually controlled by adjusting the output constant current, set by mean of an external resistor; moreover "dimming" is often used and comprises switching ON/OFF the current at high rate (a switching frequency of few MHz may be used). If a 5 MHz dimming is implemented (with a 50% duty-cycle), the driver is used to have a rise time much shorter then the 100 ns half period.

An output setup time, for example, less then 20 ns, may be needed at least to improve the performance of the system. If the simple architecture of FIG. 1 is used, very high performance in terms of GBW and slew rate would be demanded of the Op-Amp in order to meet with the specifications.

High slew-rate and bandwidth provides for high bias currents, a relatively complex design for the Op-Amp, high large power consumption and high silicon area consumption, especially in multi-channel devices (to be noted that 16 channels are very frequently used). It is also known to resort to additional support circuitry to improve the speed of the driver.

As known, "one-shot" circuit may be used, as depicted in FIG. 4, for providing a suitable amount of current in a pulsed way; this may help in charging the gate of the power DMOS in a very short time. There remain several potential drawbacks and limitations in these known techniques for fast switching current driving of loads such as a LED: 1) The switching performance of known circuits are strongly dependent on: the output current level; the electrical characteristics of the load LED (i.e. its equivalent RC circuit); the size of the output power element (dictated by current capability specifications); and the bandwidth and slew rate characteristics of the Op-Amp. 2) Under the same output current (IOUT) conditions, if the circuit may drive LEDs of many different characteristics, a large spectrum of resistive loads may be considered in the equivalent circuit: by dimensioning the system to match the rise time specifications for the higher values of load resistance (worst case), it may exhibit unacceptable current spikes at lower load resistance values; and because of Miller's multiplication effect, the gate capacitance increases with the load resistance, moreover the $C_{GD}$ increases with the consequent lower drain voltage.

3) Under identical resistive load conditions, speed performance is greatly dependent on the output current level to be set. Because of the different levels of gate voltages that are requested at different currents, there may be a risk of not matching all the specifications because if the device may provide for a wide range of currents to be set, it is not simple to match the speed requirement at, for example, 80 mA and the current spikes constraint at 3 mA (as a matter of fact, the one-shot current could be "too low" in the first case and "too high" in the second one). The circuit would need additional circuitry to modulate and control the "energy" of the "one-shot" circuit on the basis of the set level of the output current.

4) Under same resistive load and output current conditions, the rise time is dependent on the external supply voltage VLED. In fact, as it is well known, the parasitic capacitance $C_{GD}$ is inversely proportional to the $V_{DS}$ voltage value. For this reason, even if the charge current (energy) is modulated in dependence of the output current, the overshoot in the output current increases with VLED.

The problem with the "one-shot" technique may be the difficulty to control the gate charging process in all load and $I_{OUT}$–VLED conditions. Often the gate voltage and hence the output current exhibit high spikes that can reach 50% or even more of the final value of the set output current. On the other hand, expedients to reduce the spike (the quantity of current charging the gate and/or the duration of the pulse) may slow-down the device, risking not meeting the speed requirements. A difficult trade off is generally sought between speed and current spike issues.

In U.S. Patent Application Publication No. 2008/0012507 to Nalbant, a variety of techniques for fast switching through high brightness and high current LEDs using current shunting devices are disclosed. The disclosed techniques may be burdensome to implement in multi-channel devices, e.g. 16 channels, because of large silicon area and power consumption in view of the fact that the shunting device may be sized to divert the full load current.

U.S. Pat. No. 6,346,711 to Bray describes a technique to improve the response time that makes use of additional current feed components to the LED during its illumination phase. The additional large size switches and related control circuitry (all switches may carry the maximum design current) increase, significantly the silicon area and power consumption.

U.S. Pat. No. 6,144,222 to Ho discloses a high speed programmable current driver used for infrared LED communication devices. Large area critical precision requirements in a multi channel device may be burdensome. U.S. Pat. No. 6,469,405 to Moya et al. discloses a technique to reduce overshoot issues. Also this technique uses additional switches in the output current path, which may be suitably sized for the maximum design current at minimum voltage drop condition.

U.S. Pat. No. 6,734,875 to Tokimoto et al. and U.S. Pat. No. 6,288,696 to Holloman are other publications dealing with LED displays. In the latter, a technique is disclosed to control the current driving by an analog voltage set by an analog drive line including a sample and hold circuit. Drivers designed, for example, for full color full motion video applications, often use internal pulse width modulation (PWM) controls, which give the capability to increase the visual refresh rate and to reduce flickering effects, thereby improving fidelity.

This, together with the need to suitably modulate the brightness of the LEDs, could make the driver output capable of being switched ON/OFF at high rates (according to this technique, the "ON" period can be scrambled into several short "ON" periods). Indeed, pulse widths as short as 30 ns could be requested and the driver circuit may be fast enough to set the current at a stable level within such pulses of extremely short width.

In any case, it is always of paramount importance to reduce as much as possible and ideally prevent any switching spike produced by fast switching circuits such as drive current source circuits. This avoids damage to a driven load as a LED, power dissipation (specially in case of a multi-channel device simultaneously switching array LEDs) and EMI issues. Moreover, for securely dealing with very short pulses, it is important to control intensity and duration of the spike, in order to avoid appreciably varying the mean value of the current (e.g. the brightness within the illumination phase of a driven LED).

SUMMARY OF THE INVENTION

There is a need for an effective, less burdensome and efficient way of providing short rise time spike-free output currents.

An approach is a method and a circuit, a characteristic of which may be an ability to provide constant currents of a certain set value, the rising and falling edges of, which are much shorter then the design minimum on-phase. Essentially, these results may be obtained by keeping an operational amplifier that controls the output power switch, in an active state during off phases of an impulsive drive signal received by the current source circuit, in order to maintain the output voltage of the operational amplifier at or just below the voltage to be applied to the control terminal of the output power switch during a successive on phase of a received drive pulse signal.

According to an embodiment, the current source circuit may receive drive pulses for an electrical load to be driven and may have a replica branch between a power supply node of the circuit and ground that includes scaled replicas of the output power switch and of the current sensing resistor that are connected in series to the load, for providing an inner scaled replica feedback loop nested to an outer or power feedback loop of a common operational amplifier (op-amp) that outputs the drive voltage level of the gate of the output power switch.

During, off phases alternated to the drive pulses, the op-amp may be maintained in its active zone for keeping the gate of the scaled replica of the output power switch at the correct drive voltage while a grounding switch, connected to the gate of the output power switch, turns it off. A low impedance node may be "imposed" at the gate of the scaled replica switch of the inner replica feedback loop, which may make the gate node less sensitive to transients and reduce output current overshoots.

Besides the results in terms of an almost complete elimination of overshoots under a broad range of current driving conditions, scalability of the components of the added replica branch for implementing an inner feedback loop may be possible. The three control switches and the inverter used for switching between an ON-phase configuration and an OFF-phase configuration of the circuit may be of small size, implying a relatively small area consumption.

The exemplary and non-limiting drawings discussed below and the various embodiments used to describe the principles of the present invention in this document are by way of illustration only and should not be construed in any way to limit the scope of the invention. Those skilled in the art may understand that the principles of the present invention may be implemented in current source circuit designed for other applications.

DETAILED DESCRIPTION OF THE PREFERRED EMBODIMENTS

Figure 1:
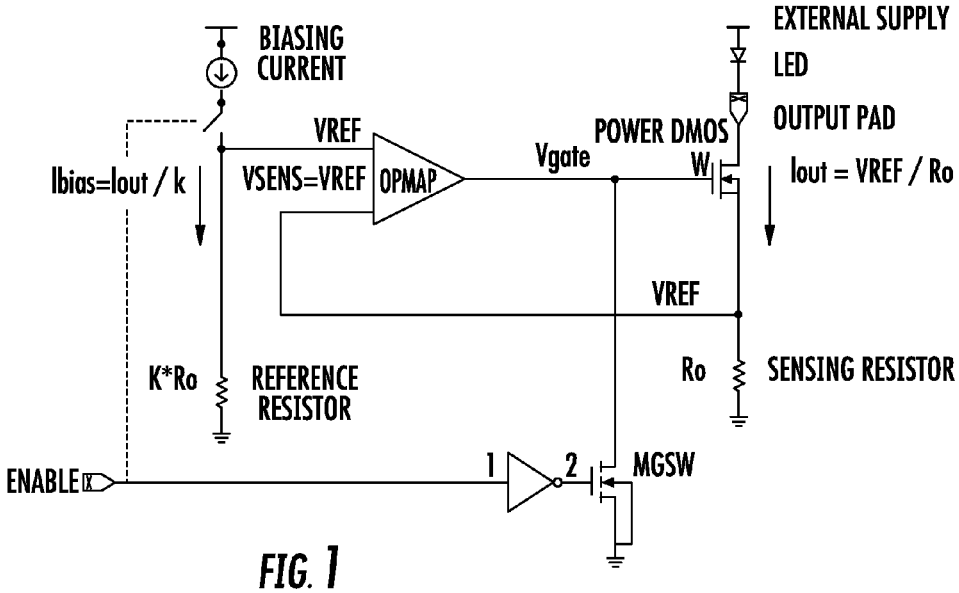
FIG. 1 PRIOR ART
FIG. 1 shows a basic LED driver circuit, according to the prior art.
Figure 2:
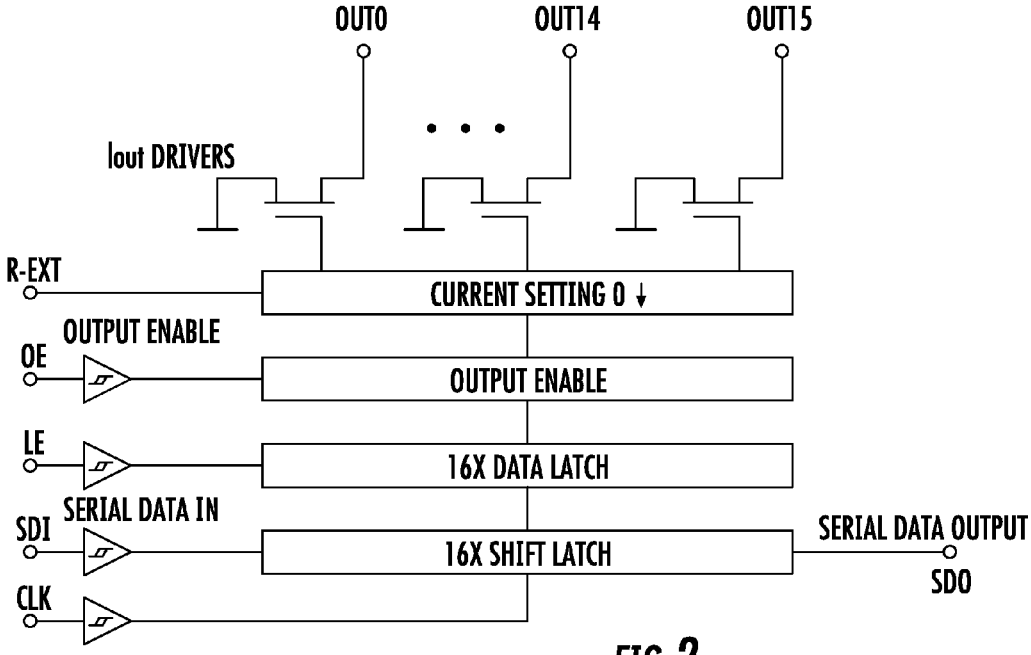
FIG. 2 PRIOR ART
FIG. 2 is a block diagram of a 16 channel LED display driver, according to the prior art.
Figure 3:
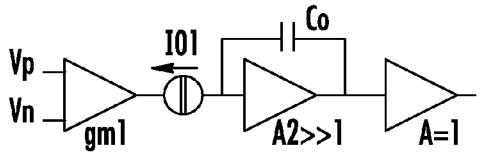
FIG. 3 PRIOR ART
FIG. 3 shows a general scheme of an operational amplifier, according to the prior art.
Figure 4:
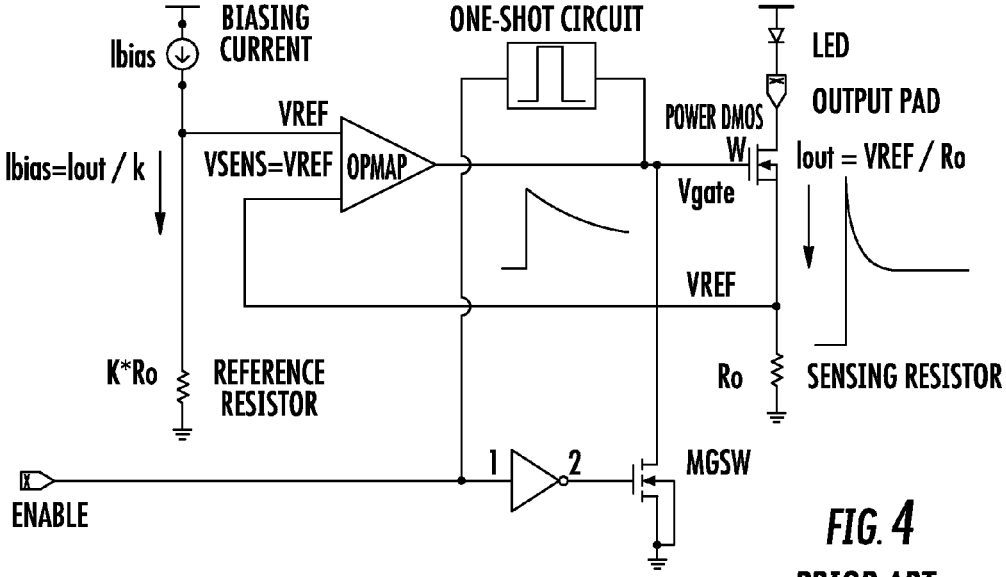
FIG. 4 PRIOR ART
FIG. 4 shows a modified LED driving circuit for speed enhancement, according to the prior art.
Figure 5A:
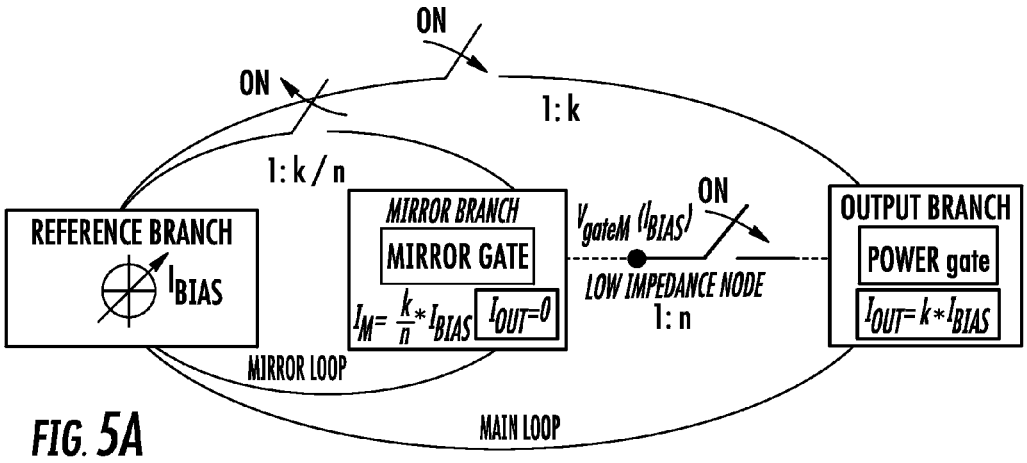
FIG. 5*a* is a basic functional diagram of the fast switching overshoot free current source circuit, according to the present invention.

With reference to the diagram of FIG. 5*a* that represents the principle of functioning of the current source circuit of this disclosure, the inner replica feedback loop includes an n time scaled down replica of the power switch (e.g. a DMOS of size W/n, where W is the size of the output power DMOS) and a sensing resistor of n time greater resistance (e.g. of resistance $n*R_0$ where $R_0$ is the resistance of the sensing resistor of the main or reference feedback loop). At the gate of the output power element, the ideal (Thevenin equivalent) situation is represented by the equivalent circuit of FIG. 5*b*.

Figure 5B:
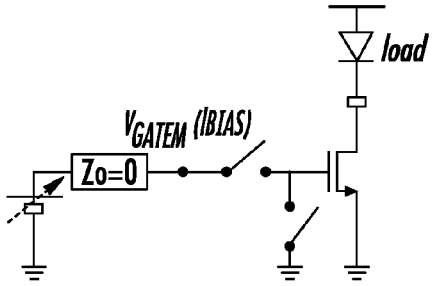
FIG. 5*b* shows an ideal Thevenin's equivalent circuit of the diagram of FIG. 5*a*.

As may be immediately recognized by observing the circuits of FIGS. 5*a* and 5*b*: speed depends by the speed with which the control switches couple either the replica feedback loop (briefly designated with an added "M" notation, short for "mirror") or the main reference feedback loop to the dedicated input of the op-amp; this dramatically shortens rise time and allows a good control of the "energy" that charges the gate of the output power switch at turning ON instants.

In practice, as shown in FIGS. 5*a* and 5*b*, this invention provides for a substantially ideal voltage generator of practically null output impedance for biasing the gate of the output power device of a current drive circuit. The null impedance output node of the biasing voltage source renders this node insensitive to ringings.

Figure 6:
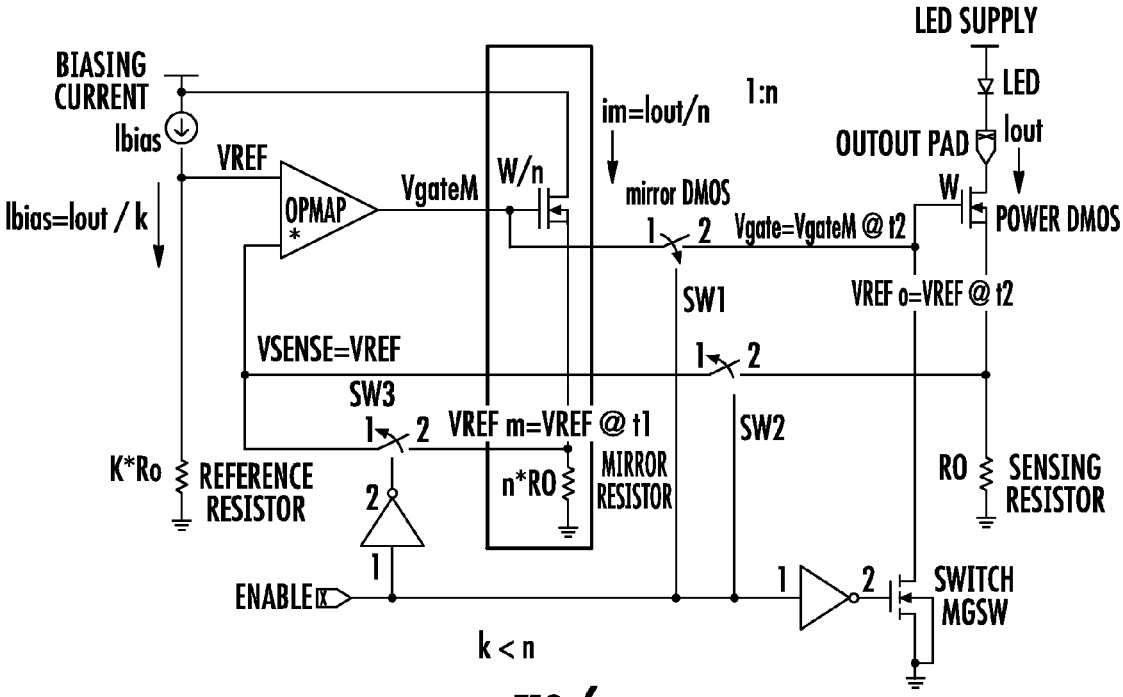
FIG. 6 is a basic circuit diagram of an embodiment of a current source in the form of a LED driver circuit, according to the present invention.

By way of example, a basic circuit diagram of an embodiment of a current source of this invention in the form of a LED driver is depicted in FIG. 6. The indicated LED load may be a single LED or a plurality of LEDs in series. In the present context, when referring to and illustrating a driven LED or the LED load of the current source circuit, it is intended either a single LED or a plurality of LEDs in series (a chain of LEDs) or any other electrical load to be driven of equivalent or similar electrical characteristics. The relevant electrical parameters remain in any case as the load resistance and the load capacitance as seen at the output node of the current source circuit of this invention.

Figure 7:
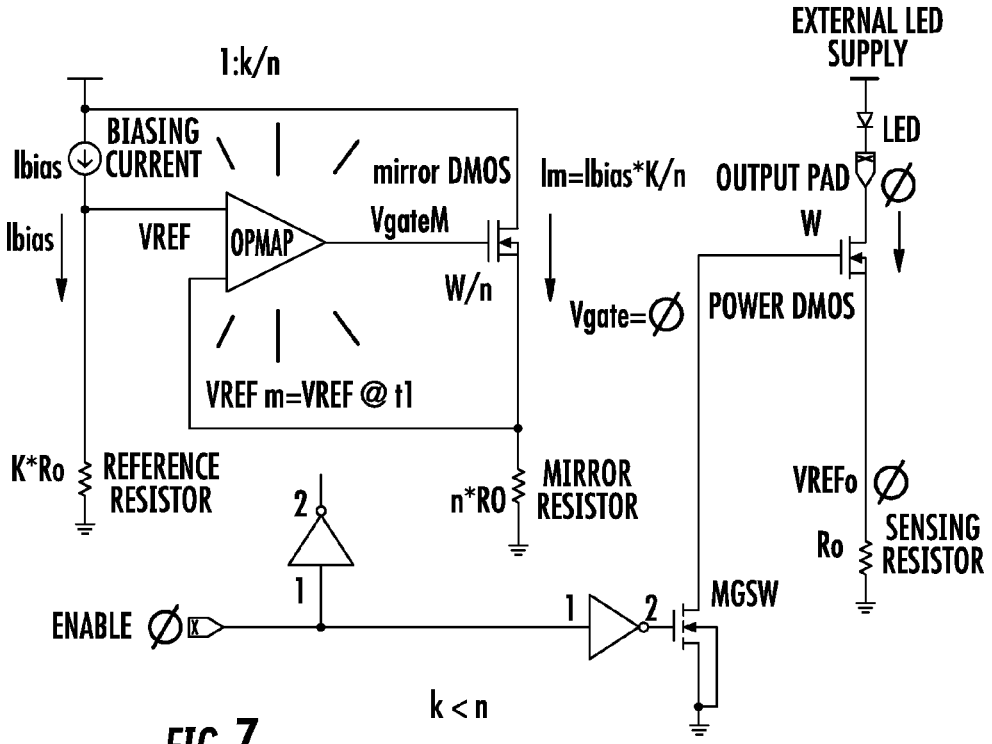
FIG. 7 shows the configuration of the circuit of FIG. 6 during off phases of a driven LED.

When the ENABLE signal, which represents the drive pulse signal that is input to the driver circuit, is LOW (zero output current during an OFF phase of current driving), the scaled replica DMOS of W/n size is in an active inner feedback replica loop configuration, depicted in FIG. 7, determined by the opening of the control switches sw1 and sw2 and the closing of sw3.

Figure 8:
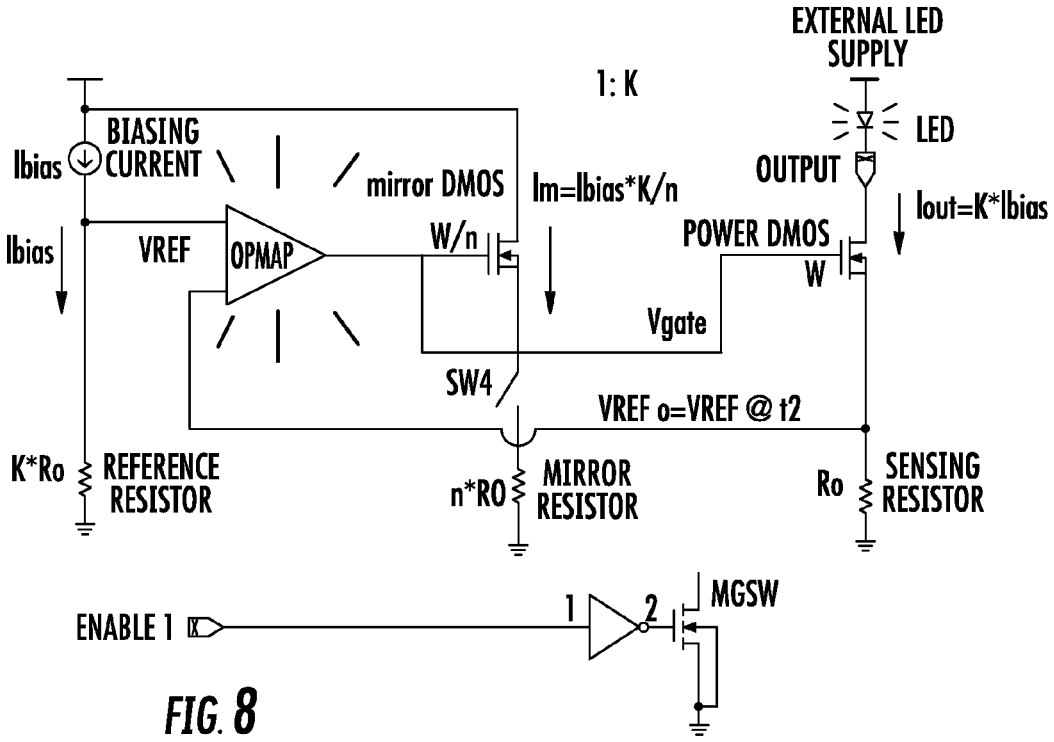
FIG. 8 shows the configuration of the circuit of FIG. 6 during on phases of the driven LED.

The gate switch MGSW may be ON, forcing OFF the output power DMOS (no current flows through the driven LED) and the inner feedback replica loop is active. By considering the sizes of the devices that comprise the replica loop and the relationship among the signals of the circuit of FIG. 6, the inner feedback replica loop biases the scaled down replica DMOS at a current $$I_M = I\text{bias}*(k/n) = I\text{out}/n,$$

and its gate is biased at a voltage level $\text{Vgate}_M$ of value exactly equal to the one Vgate requested for the output power DMOS to sink the desired current from the LED load when the circuit configuration switches to that of FIG. 8, determined by the closing of the control switches sw1 and sw2 and the opening of sw3, upon a transition to HIGH of the ENABLE signal (for driving the desired output current through the LED).

This accomplishes a kind of modulation of the "energy" that may charge the gate of the output power DMOS in function of the set output current level. Moreover, the op-amp is kept active also during OFF phases.

As depicted in FIG. 8, when the ENABLE signal is HIGH, the gate switch MGSW may be OFF. The replica feedback loop is interrupted and the main feedback loop that includes the output branch of the output power DMOS and sensing resistor $R_0$ may close, biasing the source of the DMOS at $V_{REF}$ and its gate at Vgate that forces an output current through the LED of value:

$$I\text{out}/Ro) = V_{REF}/Ro.$$

Preferably, during ON phases, the replica feedback loop is interrupted, for example, as shown in FIG. 8, by an additional switch sw4 connected in series with the other components of the branch. Although the current flowing in the branch is very small, interrupting it avoids any undue current consumption in the particular case that the ENABLE be high (driver ON) and the output branch accidentally be an open circuit (for example, because the LED is damaged or an incorrect procedure has occurred in the application). Of course, any other suitable output power device, different from the DMOS of the exemplary embodiments of FIGS. 6, 7 and 8, can be used.

Dynamic Characteristics of the Current Source Circuit

By virtue of the fact that the op-amp is kept in its active zone, it does not need to rely on particularly enhanced slew rate characteristics when an ON phase starts. Speed is limited solely by the finite ON resistance of the circuit configuring control switches and by parasitic capacitances. Therefore, even an op-amp of modest gain-bandwidth characteristics can be satisfactorily used with consequent design bonuses in terms of reduced complexity and reduced area and power consumption.

Advantageously, this makes the gate-source charging less dependent from the set output current level. In fact, if the op-amp had to rely on its slew rate characteristics to rise the gate voltage as in prior art circuits, the rise time would increase with the output current value, because a proportionately higher Vgate value would be requested.

When the output power device is disabled (ENABLE=0), the scaled replica device is biased at a current given by:

$$I_M = I\text{bias}*(k/n) = I\text{out}/n,$$

and its gate is biased at a voltage level whose value corresponds exactly to the one requested for the output power to provide for the output current. This effectively responds to the need of modulating the gate charging "energy" on account of the set output current level.

Figure 9:
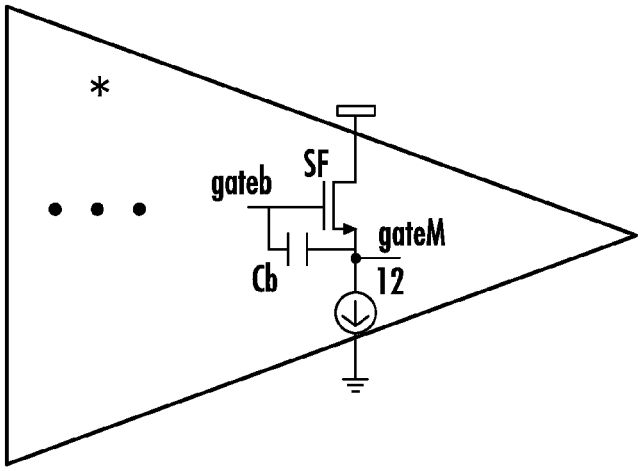
FIG. 9 and FIG. 10 show two alternative output stages for the operational amplifier, respectively, according to the present invention.
Figure 10:
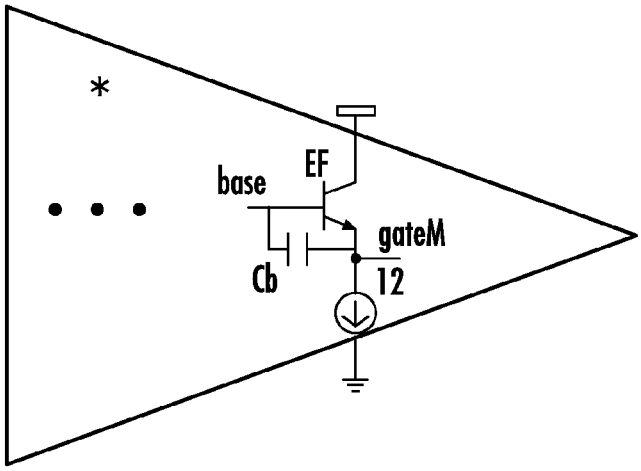

The use of an emitter follower (FIG. 9) or a source follower (FIG. 10) as output stage of the op-amp that drives the gate of the scaled replica device as well as of the output power device, or of any other equivalent low impedance output stage, for example, a class AB stage, should make the gate node a low impedance node (the impedance seen is 1/gm). Therefore, this critical node is not so sensitive to transitions, and the generation of current spikes is effectively reduced.

This arrangement, besides providing for transient current charging of the gate node, because of the control of the biasing (the energy with which the charging process is done) carried out by the replica feedback loop during OFF phases, may be thought of as a kind of "well controlled" one-shot circuit.

From the above considerations, it comes out that the circuit architecture attenuates the otherwise critical dependence of current rise time from the parameters of the equivalent RC circuit. By dimensioning the circuit to meet the specifications at the highest design value of a load resistor, much improved performances are obtained when selecting lower resistance values, without generating significant current spikes. Thus, under the same load resistance and output current conditions, by increasing the load supply voltage value $V_{LED}$, dynamic performances can be enhanced without causing significant current spikes.

A LED driver made according to this invention can be switched ON/OFF at remarkably high rates. Under certain conditions, rise times below 10 ns are achievable (suitable for implementing a high frequency PWM control and high speed data transmission). Under the same conditions of output current level and electrical characteristics of the LED load, it is possible to change/adjust the current rise time by acting on the size of the scaled replica DMOS (and also of the replica sensing resistor). For example, by increasing the size of the scaled replica DMOS, with respect to the reference design value Win (reference parameter) while keeping unchanged the current $I_M$ flowing in the replica branch, the driver may be slowed, as may be described in more detail later.

The ratio n between the currents in the output branch and in the replica branch may be chosen on the basis of power consumption considerations and/or of area occupancy constraints (a scaled replica DMOS can be of a small fractional area of the area of the output power DMOS). The architecture is particularly suited for integrated multi-channel systems and large volume productions.

An Effective Quantitative Design Approach

Figure 11:
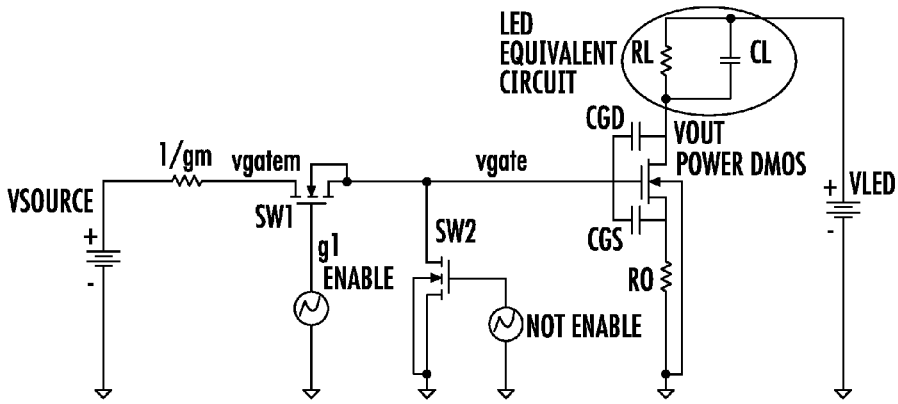
FIG. 11 is a simplified equivalent circuit of the current source circuit of FIG. 6.

The behavior of a fast switching, overshoot-free current source circuit of this disclosure (e.g. the circuit of FIG. 6) can be assessed by referring to the simplified equivalent circuit depicted in FIG. 11. Vsource and the resistor 1/gm represent a model operation (i.e. Thevenin's equivalent circuit) of the emitter/source follower in the inner replica feedback loop.

Figure 12:
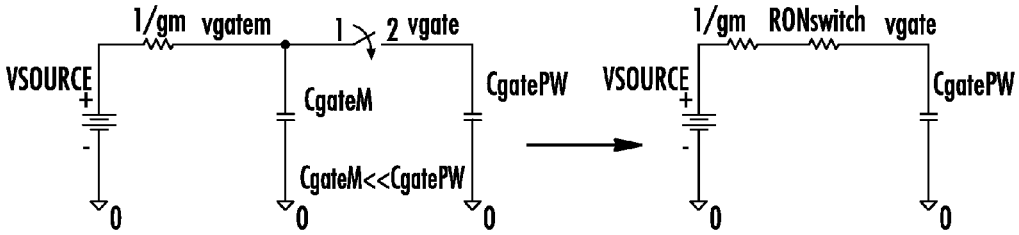
FIG. 12 shows further reductions to equivalent circuits, according to the present invention.

The resistor $R_0$ serves as a negative feedback device, setting and limiting the output current. The load LED is notably modeled by an equivalent RC parallel. The circuit of FIG. 11 effectively models the circuit of FIG. 6, Vsource being a perfect (ideal) zero impedance output node. At the gate of the output power DMOS, the equivalent circuit can be further reduced, as indicated in FIG. 12, to a simple RC circuit. Practically, CgateM is the overall capacitance of the gate node of the scaled replica DMOS (including the parasitic capacitances of the circuit configuring control switches), which can be neglected if compared to capacitance of gate node of the output power DMOS, for a significantly large scaling factor.

The rise time of the gate voltage vgate, of the output power DMOS, can be approximated to:

$$t_{RISE}(\text{gate}) \approx 2.2 * \tau_{gate}$$

where $$\tau_{gate} = \left(\frac{1}{gm} + R_{SW}\right) * C_{gate},$$

and $R_{SW}$ is the ON resistance of the MOS control switch SW1 (which thus may be suitably dimensioned). The rise time of both the gate node voltage and the output current is strictly dependent (increasing with) from the value of the load resistance $R_L$ in relation to the parasitic capacitance of the output power DMOS, in particular $C_{GD}$, and hence on its size.

Figure 13:
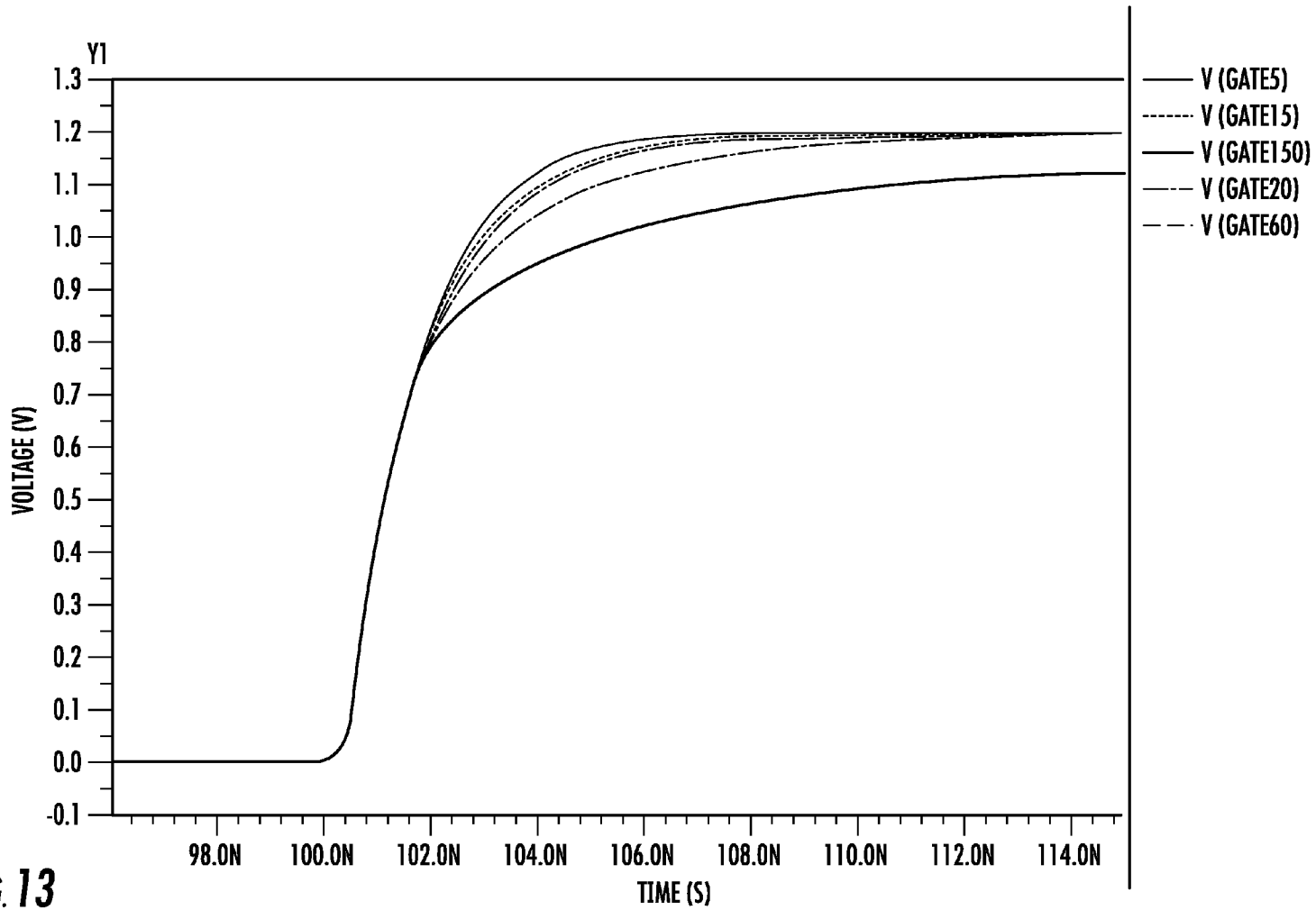
FIG. 13 is a diagram showing the gate, voltage variation characteristics for different resistive loads, according to the present invention.
Figure 14:
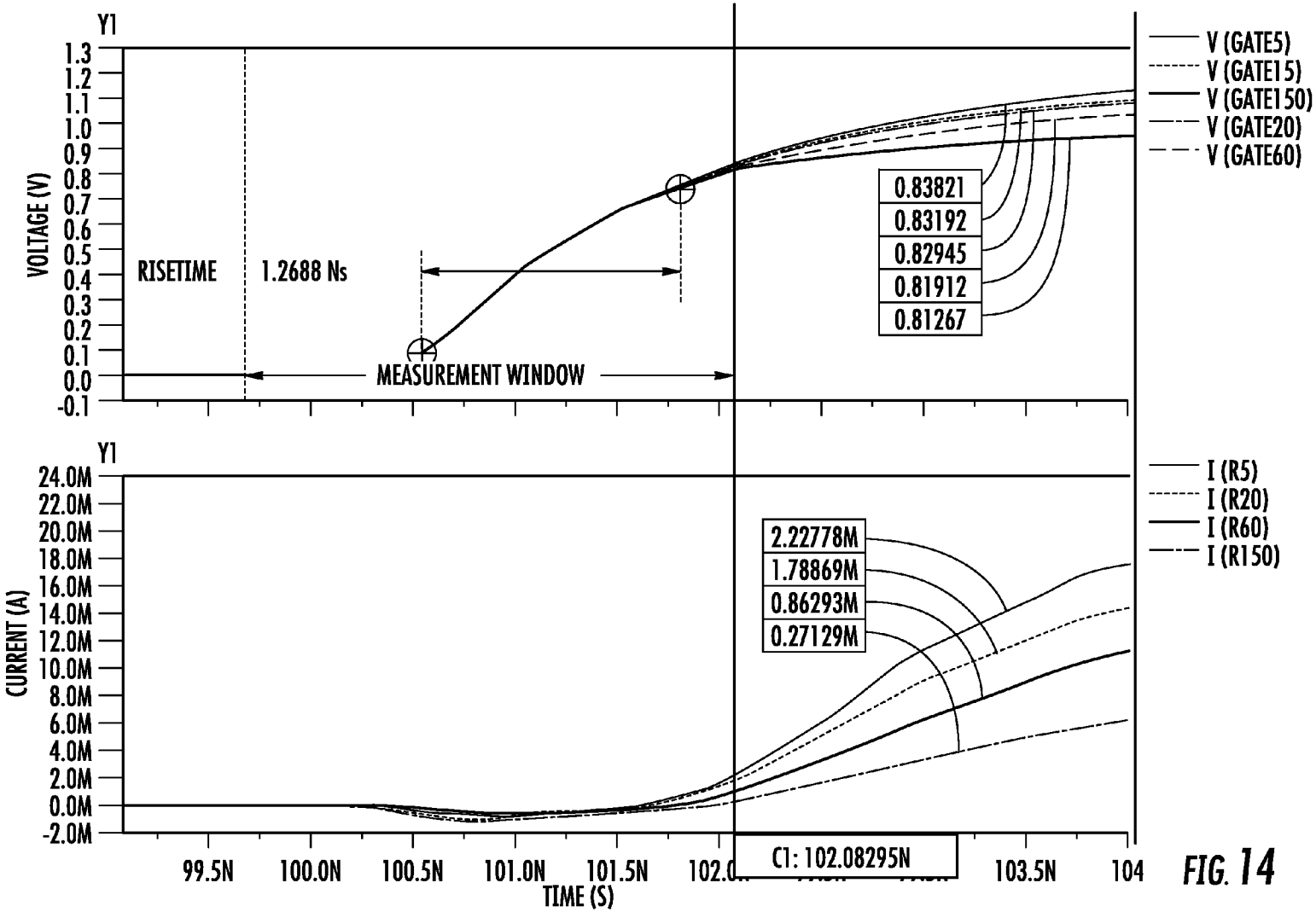
FIG. 14 shows enlarged parts of characteristics, just beyond the starting edge of the gate voltage variation, according to the present invention.

FIGS. 13-14 show the gate voltage and the load current waveforms of the circuit of FIG. 11, without considering the effect of the load capacitance $C_L$, after the instant (t0-100 ns) in which SW1 is closed and SW2 is opened. A 20V DMOS (0.35 um technology) has been used, with $V_{LED}$=4.5V, $R_L$ varying from 5 Ohm to 150 Ohm, ($C_L$=10 pF). The DMOS size was W=4800 um, and the output current was 20 mA.

As observed from FIG. 13 and FIG. 14, until the output power DMOS is not significantly conducting (vgate about 0.8V), the rising edge of the gate is practically independent from the value of $R_L$. Beyond this point, the $C_{GD}$ of the output power device senses the effect of the increasing current and hence of the decreasing of the drain voltage with $R_L$. If it may be possible in first approximation to use the MOS active zone equations, this would be as if the $C_{GD}$ would experience a Miller's multiplication effect and an effective gate capacitance increase (basically $C_{GD}$ increases because of a decreasing of the drain voltage with $R_D$).

Two different time constants are involved in the rising of the gate voltage, by approximation and considering only the Miller's effect:

$$\tau 1_{gate} = \left(\frac{1}{gm} + R_{SW}\right) * C1_{gate}$$
$$= \left(\frac{1}{gm} + R_{SW}\right) * (C_{GS(PW)} + C_{GD(PW)}), \text{ and}$$

$$\tau 2_{gate} = \left(\frac{1}{gm} + R_{SW}\right) * C2_{gate}$$
$$= \left(\frac{1}{gm} + R_{SW}\right) * [C_{GS(PW)} + (1 + G_M * R_L) * C_{GD(PW)}]$$

where $$G_m = \frac{gm_{PW}}{1 + gm_{PW} * R_o}.$$

In an ideal case, if no parasitic elements (i.e. null $C_{GD}$) were present, the current waveform would track the gate voltage and the two rise times would be coincident (not considering any effect of the load capacitance $C_L$). The effect of $C_{GD}$ on the load current is evident: just after the rising edge of the gate, $C_{GD}$, which initially has 4.5V (=$V_{LED}$), in this example) at its terminals, cannot discharge instantaneously (in fact Vout goes to a certain extent above $V_{LED}$). In this way, the current waveform starts to deviate from that of the gate.

For the same DMOS size (same $C_{GD}$) and output current conditions, the higher the $R_L$ value, the higher the current rise time deviation from the gate rise time. From a load side point of view, if $R_L$ increases, the parasitic capacitor senses a larger time constant ($R_L$*$C_{GD}$), moreover the load line waveform flattens and the output node (together with $C_{GD}$) has to discharge a larger amount of stored energy (if $I_{OUT}$=20 mA, $V_{LED}$=4.5V, $V_{OUT}$ drops from 4.5V to 1.5V, if $R_L$=150 Ohm; while it drops from 4.5V to 4.4V, if $R_L$=5 Ohm).

Figure 15:
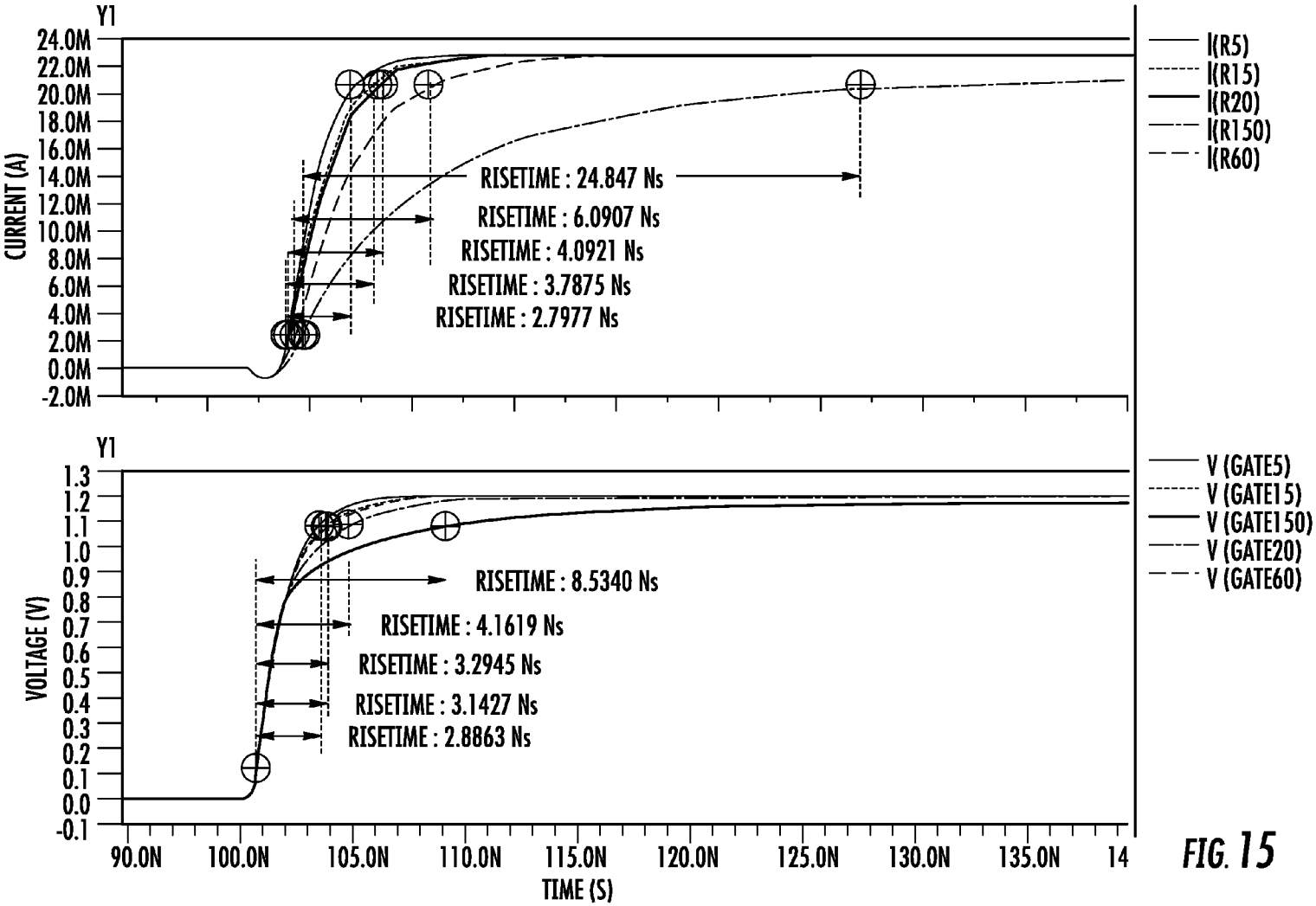
FIG. 15 includes diagrams showing the change of load current and of gate voltage raising rate in dependence of the resistive load value, according to the present invention.

For the exemplary circuit considered, the current rise time deviation from the gate rise time becomes appreciable for $R_L \geqq 20$ Ohm, as shown in the diagrams of FIG. 15. The effect of the load capacitance $C_L$ is to increase the time constants involved, in particular it may contribute about:

$$\tau_L = (r_o \| R_L) * C_L,$$

where $r_o$ is the resistance seen on the output node. The major effect is on the current rise time, while it is not so relevant on the gate rise time. For the exemplary circuit considered, a load capacitance $C_L$=10 pF has almost no influence on the rise times.

Further Simulation Results

Relationship of Gate and $Gate_m$ Nodes

Figure 16:
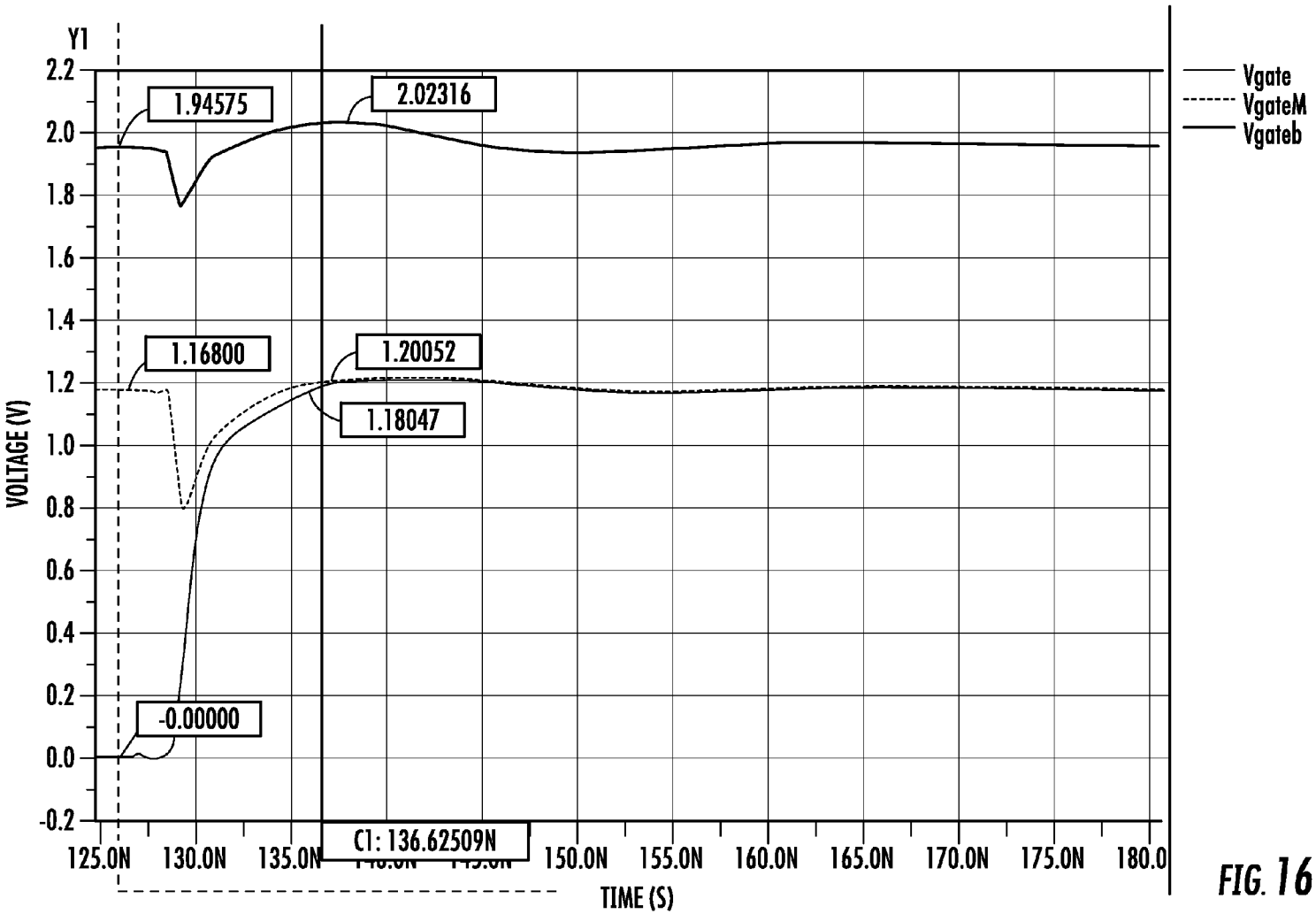
FIG. 16 and FIGS. 17A-17B are simulation waveforms describing the relationship between the replica-branch and the power-branch gate node voltages, at the transitions instant, at different values of load resistors, according to the present invention.
Figure 17A:
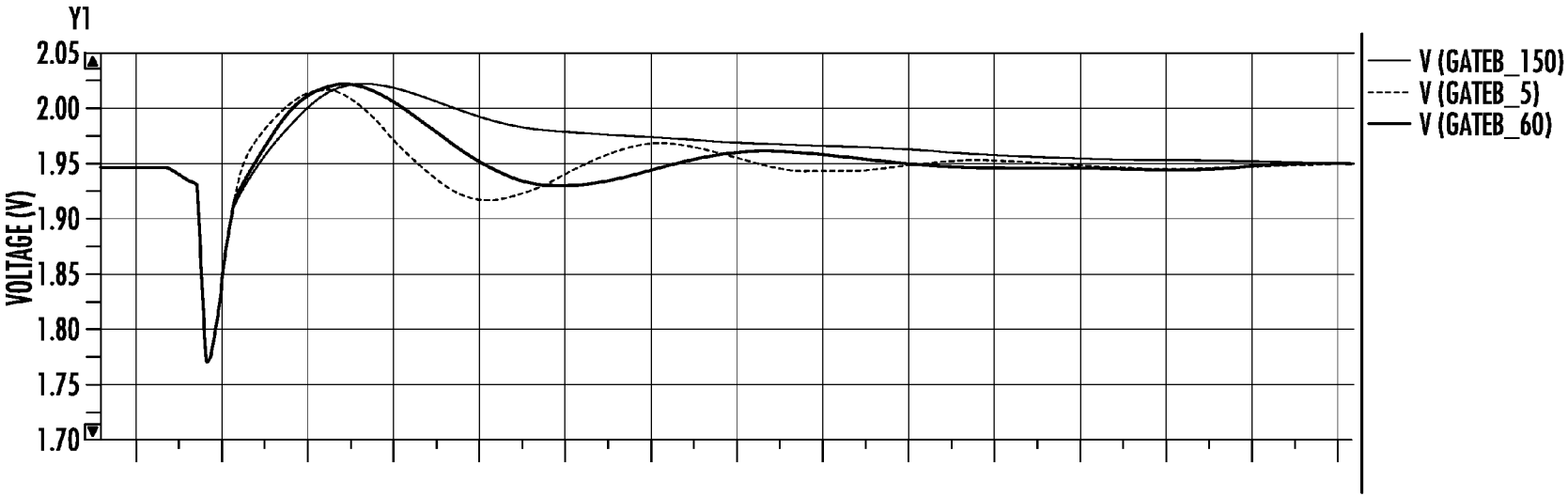
Figure 17B:
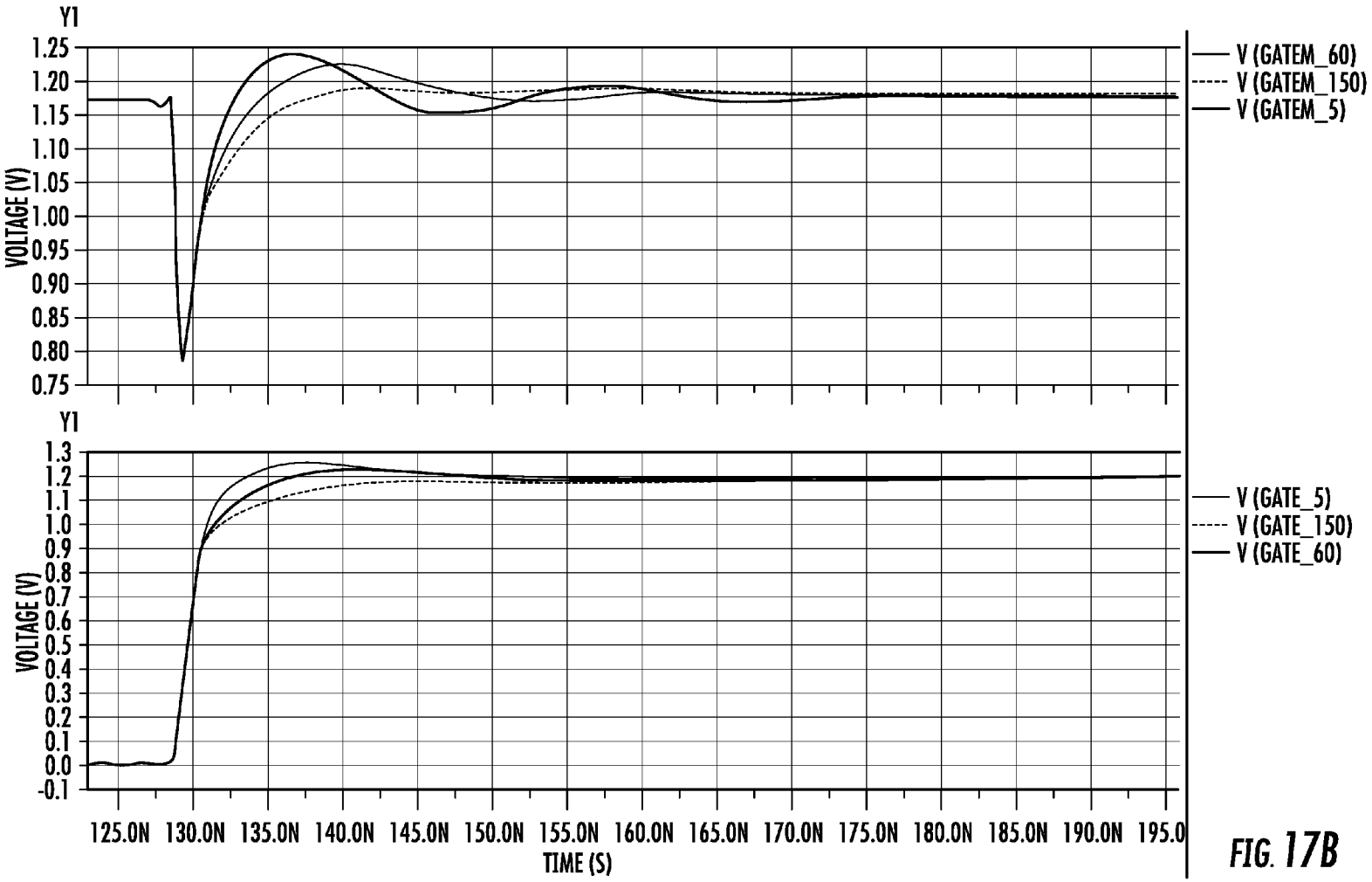
Figure 18:
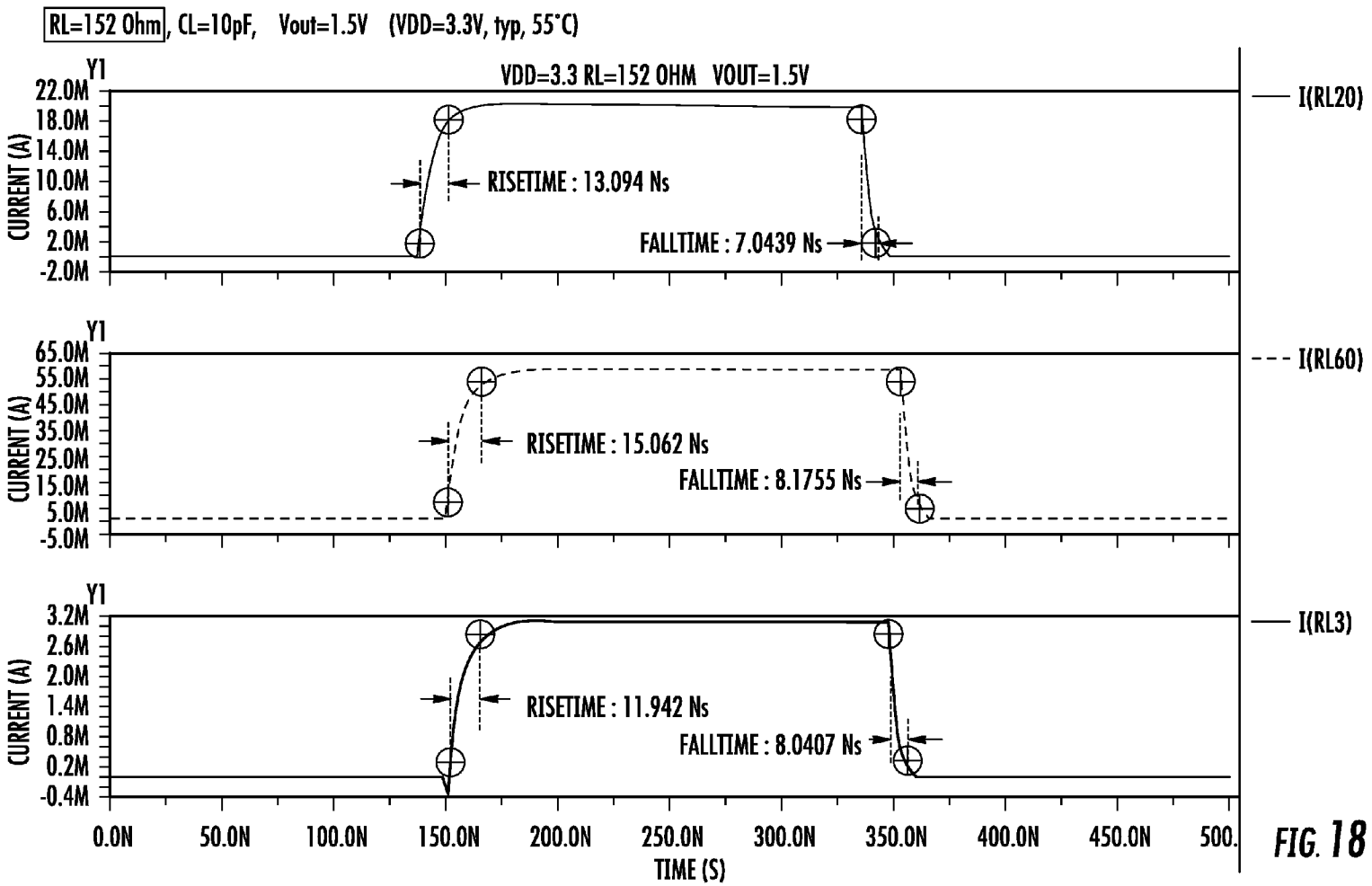
FIGS. 18, 19 and 20 are simulation waveforms for different operation parameters/conditions of the current source circuit, according to the present invention.
Figure 19:
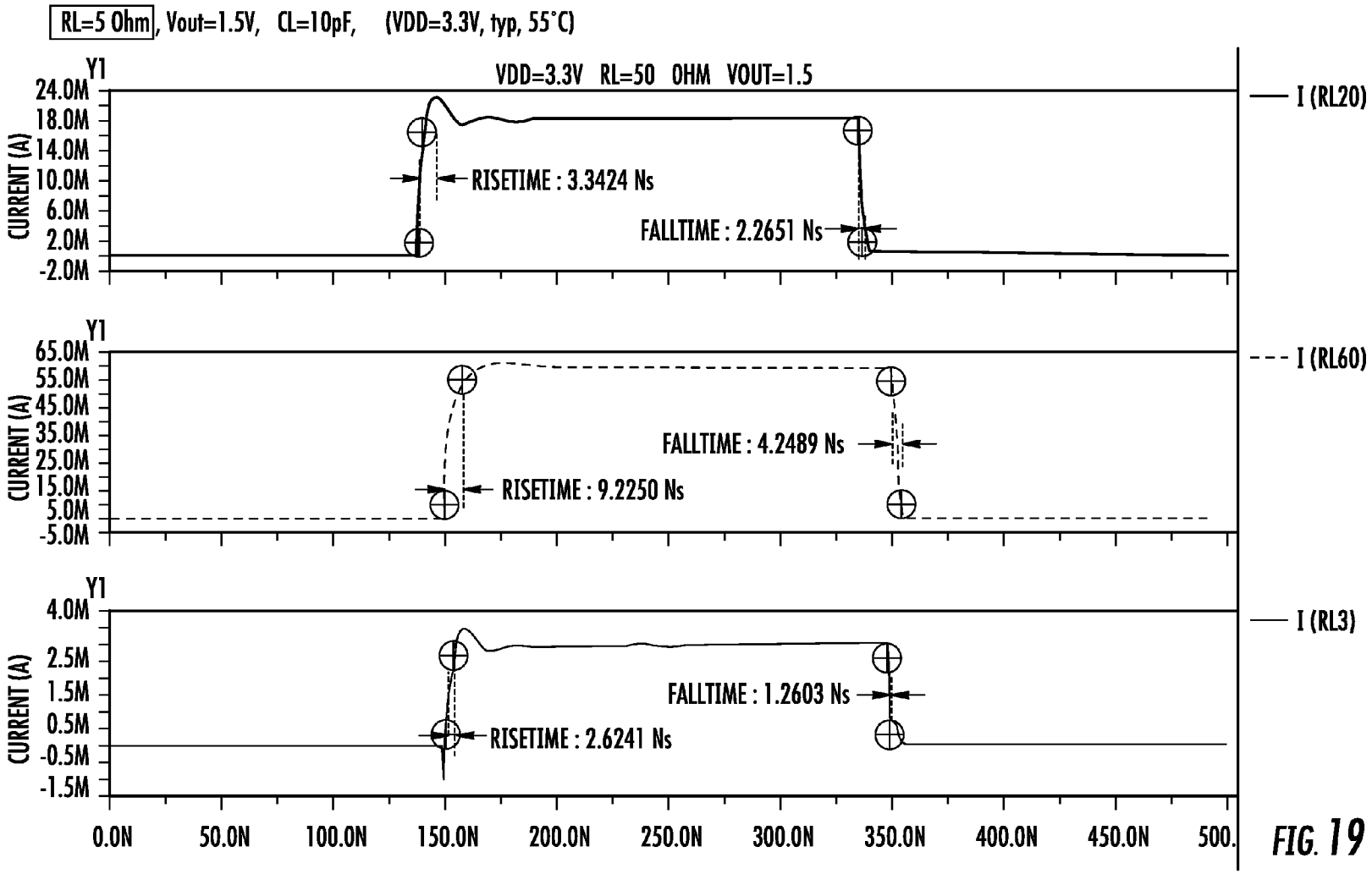
Figure 20:
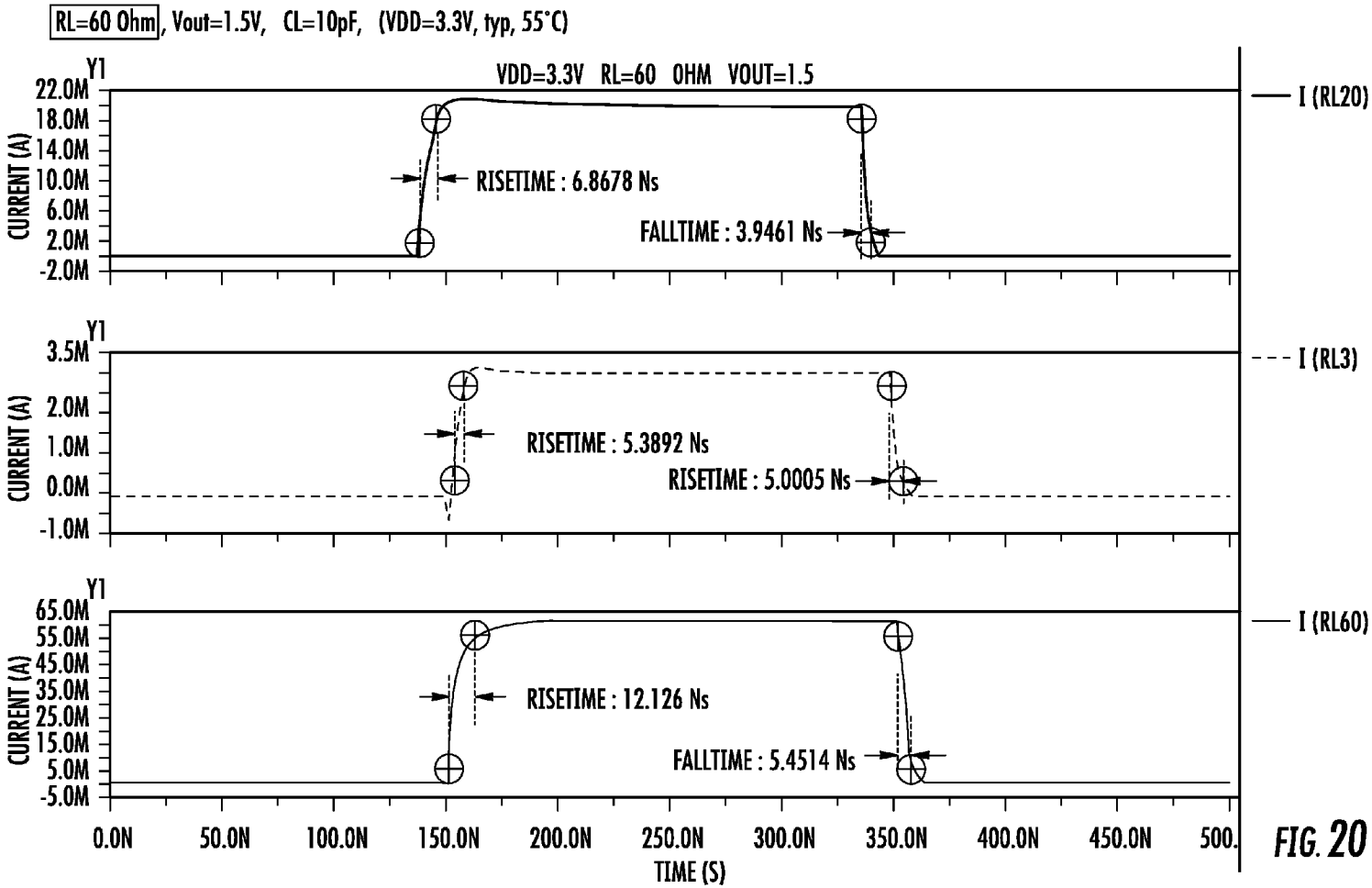

The waveforms of FIG. 16 provide an insight of the effects of parasitic elements in the real circuit of FIG. 6 (that behaves differently from the simplified equivalent circuit of FIG. 11). At the switching instant of the circuit (ENABLE=ON), the gatem node starts from a voltage level that corresponds to the steady state level of the gate node. The gateb node is one $V_{GS}$ above the level of the nodes gate and gatem (i.e. of the steady state level for the set output current). The diagrams show the movement of gateb with gate in correspondence of the switching event. Considering the real circuit of FIG. 6, at the switching on instant t2, the capacitance Cb plays an important role as far as the gateb node is not a perfect (ideal) zero impedance node. Because the Cb capacitance cannot change its potential instantaneously, the gateb voltage exhibits an overshoot that is transferred to the gatem/gate nodes and hence to the output current. Nevertheless, the overshoot is well controlled because the gateb is a low impedance node (FIG. 22 relative to critical current spike conditions).

The movements of the voltages Vgatem and Vgate and therefore of Iout follow the movements of the node gateb. The smaller $R_L$, the faster is the charging of the gate node and therefore the higher is the "ringing" of the gateb node around its steady state value. In the simulations, the supply voltage $V_{LED}$ of the driven LED was adapted to the value of $R_L$ in order to maintain a steady state voltage $V_{OUT}$ on the output pad of 1.5V. The dynamic responses for the different conditions are illustrated in FIGS. 18, 19, 20 and 21. By increasing $V_{OUT}$ above 1.5V, rising edges even shorter than 2 ns are achieved by the circuit. As expected and evident from the waveforms, the worst rise time figures are for the maximum tested $R_L$ value of 150 Ohm.

Figure 21:
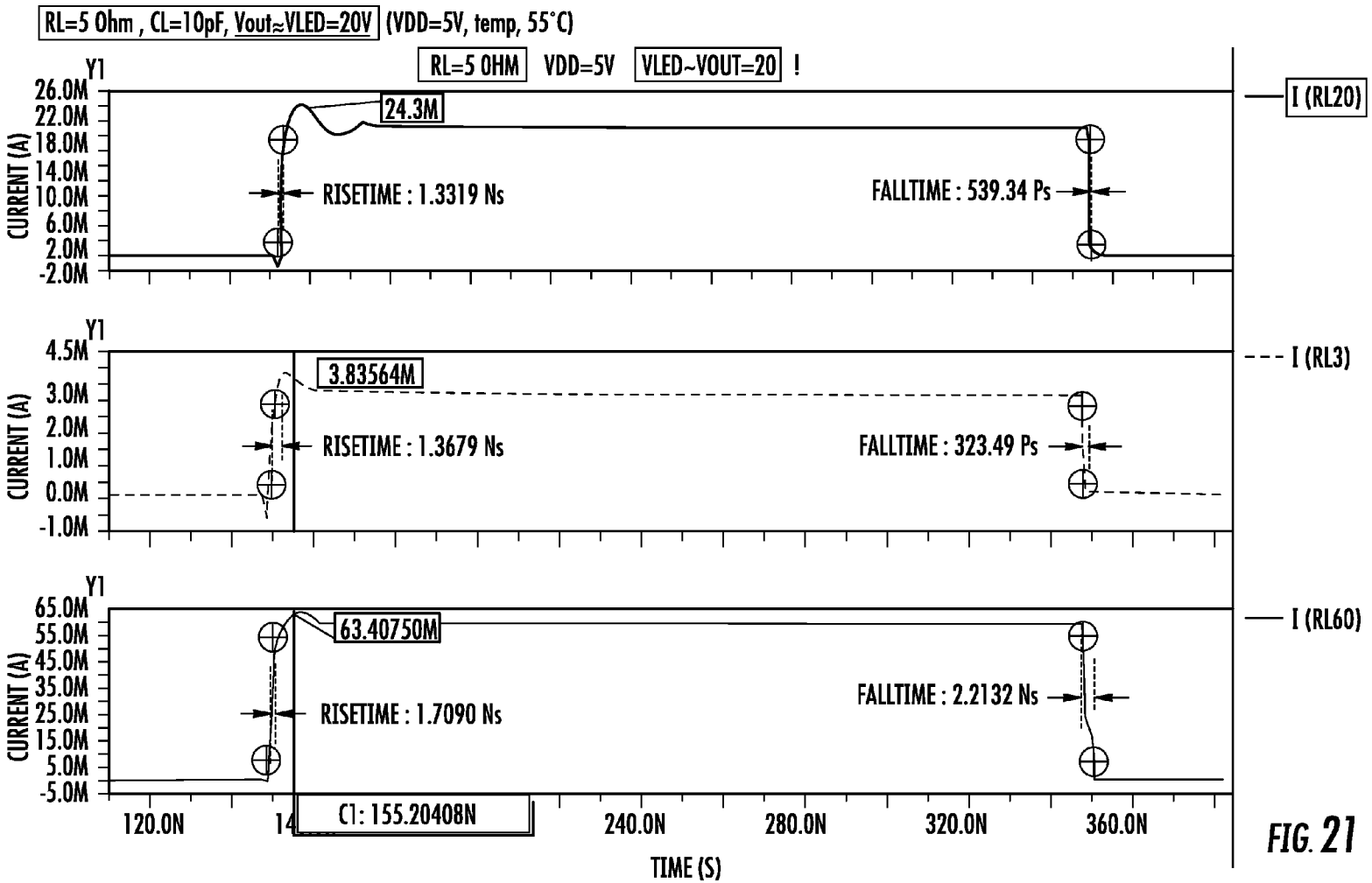
FIG. 21 includes simulation waveforms under critical conditions of current spikes generation, according to the present invention.

The longest settling time of overshoot as observed for the worst condition of $R_L$=5 Ohm, was about 30 ns, the current remaining well within 2.5% of the final value. The behavior of the driver circuit under the most critical conditions for the generation of current spikes is illustrated in the waveform of FIG. 21 for the tested maximum load supply voltage $V_{LED}$=20V and minimum load resistance $R_L$=5 Ohm. It is significant to note that rise time under same load conditions does not change significantly for the different values of the output current. This behavior may be useful in some applications.

Effect of Increasing the Size of the Replica DMOS on the Current Rise Time

Considering that as can be observed from the waveform diagrams, the gatem node starts from a lower voltage value then the steady state voltage value of the gate node, it is possible to increase by a remarkable amount the rise time for adapting it to eventual particular requests by simply increasing the size of the scaled replica DMOS from that given by design ratio W/n and/or the sensing resistance from that given by the design ratio n*$R_0$ of the replica feedback loop, because the scaled replica DMOS uses a lower $V_{GS}$ value for the loop to set the same current. This is so because the feedback signal produced by the scaled replica loop starts from a lower level than that used at steady state by the output power device, therefore, at any ON instant, the power gate voltage starts from a lower value than the used steady state value and this difference may be recouped through the relatively poor output dynamic characteristics (slew rate) of the op amp, as already commented earlier.

Figure 22:
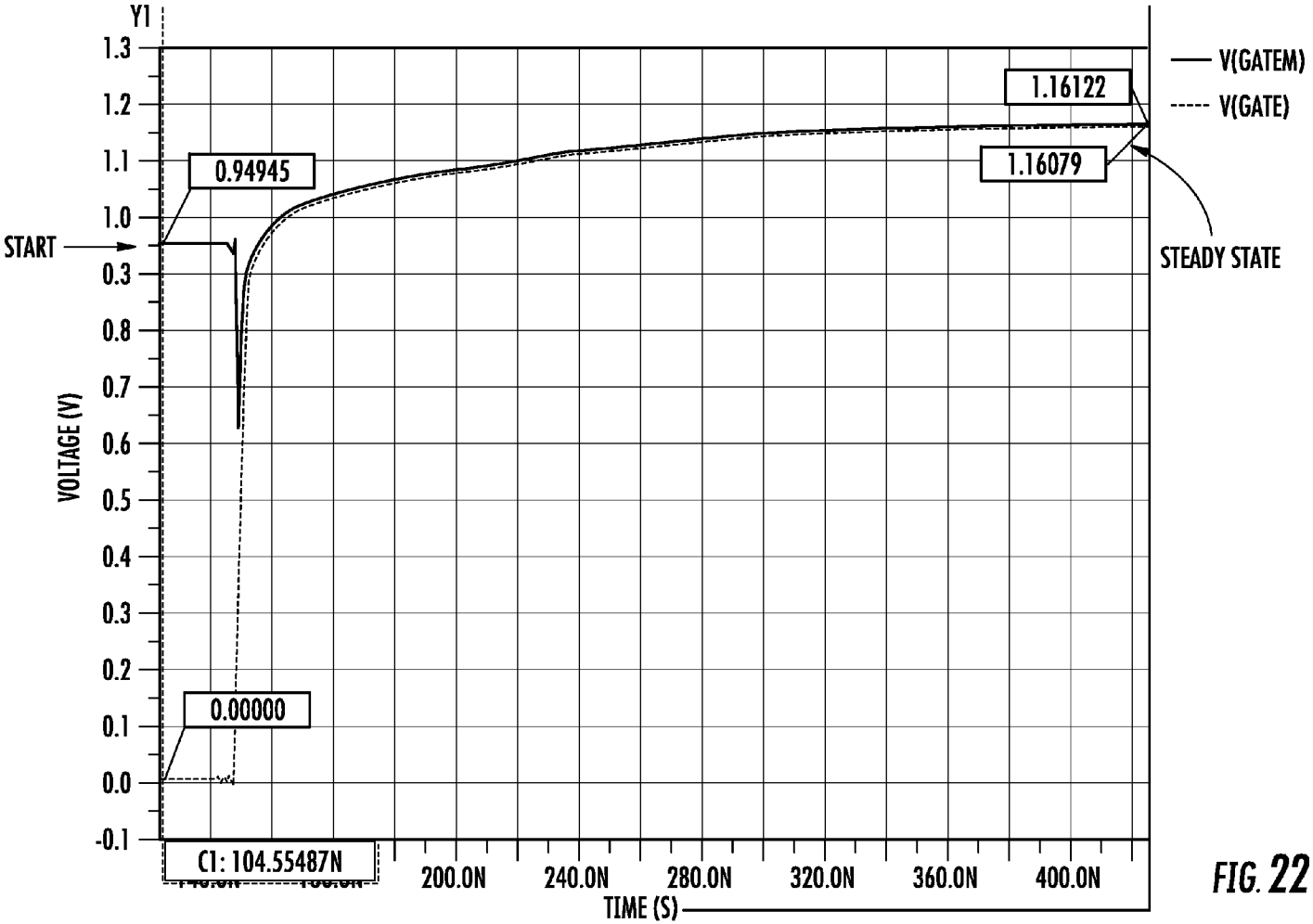
FIG. 22 and FIG. 23 describe the effect of the size of the scaled replica switch on the output current rise time, according to the present invention.
Figure 23:
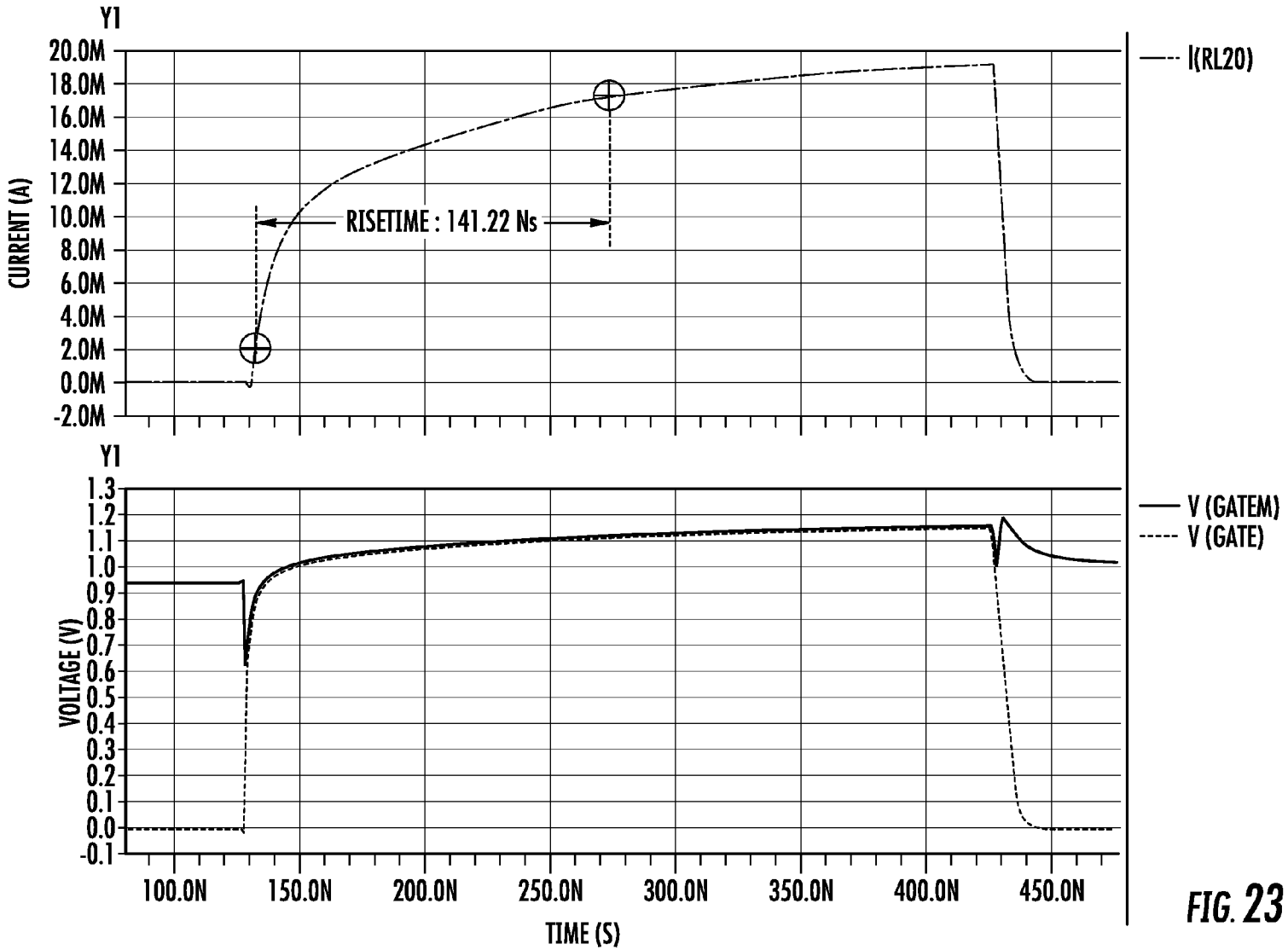

For the exemplary results illustrated in FIG. 22 and FIG. 23, the size of the replica DMOS was changed from an initial W=6 μm value to W=200 μm and the current Im flowing in the replica branch and its ratios with Ibias and with Iout were kept constant (the power ratio changes from 1:800 to 1:24).

The waveforms provide a comparison between the gate voltages before and after the switching and making evident the starting from a lower level. Some applications particularly sensitive to noise may benefit from such an effective way of implementing a more relaxed rise time when it is compatible with speed specification and desirable from a minimization of noise point of view. For example, this could be useful in display applications where neither a particularly high rate dimming or high PWM performances are requested and/or where the design of application boards is insufficiently optimized for noise and EMI immunity, because of cost reduction compromises and relatively smaller di/dt may be implemented.

That which is claimed is:

1. A current source circuit configured to receive drive pulses for an electrical load, the current source circuit comprising:

a sensing resistor;

a current amplifier including an amplifier, and a power switch configured to be controlled by an output of said amplifier and being coupled in series with the electrical load and to said sensing resistor and between the electrical load and a first reference voltage, said amplifier being input with a second reference voltage and with a feedback signal corresponding to a voltage drop on said sensing resistor;

a reference voltage switch being coupled to a control terminal of said power switch and configured to be controlled by the drive pulses;

a replica branch being coupled between a power supply node of the current source circuit and the first reference voltage, said replica branch including a scaled replica power switch having a control terminal coupled to the output of said amplifier, and a scaled replica sensing resistor coupled in series with said scaled replica power switch;

a first control switch coupled between the output of said amplifier and the control terminal of said power switch; and second and third control switches configured to be driven in phase and in phase opposition, respectively, with said first control switch for coupling in a mutually exclusive mode an input of said amplifier to said sensing resistor and to said scaled replica sensing resistor.

2. The current source circuit of claim 1 wherein said amplifier comprises an operational amplifier.

3. The current source circuit of claim 1 further comprising a fourth control switch in said replica branch and being configured to be controlled in phase with said third control switch for disabling said replica branch.

4. The current source circuit of claim 1 wherein the second reference voltage is compensated for temperature and supply voltage variation.

5. The current source circuit of claim 1 wherein said amplifier includes an output stage comprising at least one of an emitter follower stage, a source follower stage, and a class AB stage.

6. The current source circuit of claim 1 wherein said power switch and said scaled replica power switch are double-diffused metal-oxide-semiconductor (DMOS) devices; wherein said scaled replica power switch has a channel width n times smaller than a channel width of said power switch; and wherein said scaled replica sensing resistor has a resistance n times greater than said sensing resistor.

7. The current source circuit of claim 1 wherein said amplifier maintains an active state during off-phases alternated to the drive pulses by at least said replica branch for maintaining an output voltage applied to the control terminal of said scaled replica power switch at a value based upon a voltage to be applied to the control terminal of said power switch during a successive on-phase of a received drive pulse signal for a certain load current.

8. The current source circuit of claim 7 further comprising a null output impedance control voltage source providing the voltage applied to the control terminal of said power switch.

9. The current source circuit of claim 1 wherein the electrical load comprises at least one light emitting diode (LED).

10. The current source circuit of claim 9 wherein said at least one LED is supplied at a voltage different from the supply voltage of the current source circuit.

11. A current source circuit configured to receive drive pulses for an electrical load, the current source circuit comprising:

a power switch coupled between a sensing resistor and the electrical load;

a amplifier coupled to the sensing resistor and configured to receive a voltage drop therefrom;

a replica branch being coupled between a power supply node of the current source circuit and the first reference voltage, said replica branch including a scaled replica power switch having a control terminal coupled to an output of said amplifier, and a scaled replica sensing resistor coupled in series with said scaled replica power switch;

a first control switch coupled between the output of said amplifier and a control terminal of said power switch; and second and third control switches configured to be driven in phase and in phase opposition, respectively, with said first control switch for coupling in a mutually exclusive mode an input of said amplifier, to said sensing resistor and to said scaled replica sensing resistor.

12. The current source circuit of claim 11 wherein said amplifier comprises an operational amplifier.

13. The current source circuit of claim 11 further comprising a fourth control switch in said replica branch and being configured to be controlled in phase with said third control switch for disabling said replica branch.

14. The current source circuit of claim 11 wherein said amplifier includes an output stage comprising at least one of an emitter follower stage, a source follower stage, and a class AB stage.

15. The current source circuit of claim 11 wherein said power switch and said scaled replica power switch are double-diffused metal-oxide-semiconductor (DMOS) devices; wherein said scaled replica power switch has a channel width n times smaller than a channel width of said power switch; and wherein said scaled replica sensing resistor has a resistance n times greater than said sensing resistor.

16. The current source circuit of claim 11 wherein said amplifier maintains an active state during off-phases alternated to the drive pulses by at least said replica branch for maintaining an output voltage applied to the control terminal of said scaled replica power switch at a value based upon a voltage to be applied to the control terminal of said power switch during a successive on-phase of a received drive pulse signal for a certain load current.

17. The current source circuit of claim 16 further comprising a null output impedance control voltage source providing the voltage applied to the control terminal of said power switch.

18. The current source circuit of claim 11 wherein the electrical load comprises at least one light emitting diode (LED).

19. The current source circuit of claim 18 wherein said at least one LED is supplied at a voltage different from the supply voltage of the current source circuit.

20. A method of current driving an electrical load with reduced current spikes through a current source circuit configured to receive drive pulses and comprising an amplifier and a power switch having a control terminal controlled by an output of the amplifier and turned off during off-phases alternated to the drive pulses by coupling the control terminal to a first reference voltage, the power switch being coupled in series with the electrical load and to a sensing resistor between a supply node of the electrical load and the first reference voltage, a second reference voltage and a feedback signal corresponding to a voltage drop on the sensing resistor of a power feedback loop being input to the amplifier, the method comprising:

providing an inner scaled replica feedback loop nested with the power feedback: loop; and mutually exclusively coupling the nested feedback loops to an input of the amplifier by switches controlled by the drive pulses;

the inner scaled replica feedback loop being coupled to an input of the amplifier by the switches for, keeping active, during off-phases, the amplifier to apply to a control terminal of a scaled replica of the power switch of the inner scaled replica feedback loop a voltage corresponding to the voltage to be applied to the control terminal of the power switch during a successive on-phase.

21. The method of claim 20 wherein the amplifier comprises an operational amplifier.

22. The method of claim 20 wherein the second reference voltage is compensated for temperature and supply voltage variation.

23. The method of claim 20 wherein the amplifier includes an output stage comprising at least one of an emitter follower stage, a source follower stage, and a class AB stage.

24. A method for making a current source circuit, the current source circuit to receive drive pulses for an electrical load, the method comprising:

providing a current amplifier including an amplifier, and a power switch being controlled by an output of the amplifier;

coupling the power switch in series with the electrical load and to a sensing resistor and between the electrical load and a first reference voltage;

coupling the amplifier to be input with a second reference voltage and with a feedback signal corresponding to a voltage drop on the sensing resistor;

coupling a reference voltage switch to a control terminal of the power switch and to be controlled by the drive pulses;

coupling a replica branch between a power supply node of the current source circuit and the first reference voltage, the replica branch including a scaled replica power switch having a control terminal coupled to the output of the amplifier, and a scaled replica sensing resistor coupled in series with the scaled replica power switch;

coupling a first control switch between the output of the amplifier and the control terminal of the power switch; and providing second and third control switches being driven in phase and in phase opposition, respectively, with the first control switch for coupling in a mutually exclusive mode an input of the amplifier to the sensing resistor and to the scaled replica sensing resistor.

25. The method of claim 24 wherein the amplifier comprises an operational amplifier.

26. The method of claim 24 further comprising providing a fourth control switch in the replica branch and to be controlled in phase with the third control switch for disabling the replica branch.

27. The method of claim 24 wherein the second reference voltage is compensated for temperature and supply voltage variation.

28. The method of claim 24 wherein the amplifier includes an output stage comprising at least one of an emitter follower stage, a source follower stage, and a class AB stage.

29. A method of making a current source circuit, the current source circuit to receive drive pulses for an electrical load, the method comprising:

coupling a sensing resistor to a first reference voltage;

coupling a power switch between the sensing resistor and the electrical load;

coupling a amplifier to the sensing resistor, the amplifier to receive a voltage drop therefrom;

coupling a replica branch between a power supply node of the current source circuit and the first reference voltage, the replica branch including a scaled replica power switch having a control terminal coupled to an output of the amplifier, and a scaled replica sensing resistor coupled in series with the scaled replica power switch;

coupling a first control switch between the output of the amplifier and a control terminal of the power switch; and providing second and third control switches to drive in phase and in phase opposition, respectively, with the first control switch for coupling in a mutually exclusive mode an input of the amplifier to the sensing resistor and to the scaled replica sensing resistor.

30. The method of claim 29 wherein the amplifier comprises an operational amplifier.

31. The method of claim 29 further comprising providing a fourth control switch in the replica branch and to be controlled in phase with the third control switch for disabling the replica branch.

32. The method of claim 29 wherein the second reference voltage is compensated for temperature and supply voltage variation.

33. The method of claim 29 wherein the amplifier includes an output stage comprising at least one of an emitter follower stage, a source follower stage, and a class AB stage.

* * * * *